United States Patent [19]

Tuten et al.

[11] 3,996,716

[45] Dec. 14, 1976

[54] CEILING GRID ARRANGEMENT AND CONNECTOR USED THEREWITH

[75] Inventors: Gilbert Wallace Tuten, Glenview, Ill.; Paul Lewis Earle, Denver, Colo.

[73] Assignee: Johns-Manville Corporation, Denver, Colo.

[22] Filed: Sept. 15, 1976

[21] Appl. No.: 613,596

[52] U.S. Cl. ..... 52/665; 52/484; 52/715

[51] Int. Cl.[2] ..... E04B 5/52

[58] Field of Search ..... 52/665, 715, 475, 484, 52/489, 488, 719, 476, 144, 28

[56] References Cited

UNITED STATES PATENTS

| | | | |
|---|---|---|---|
| 3,397,499 | 8/1968 | Ward | 52/665 X |
| 3,785,110 | 1/1974 | Galloway et al. | 52/665 X |
| 3,848,385 | 11/1974 | Thompson | 52/475 |

*Primary Examiner*—J. Karl Bell

*Attorney, Agent, or Firm*—Robert M. Krone; Joseph J. Kelly; Stephen C. Shear

[57] ABSTRACT

A ceiling grid arrangement is disclosed herein and includes a plurality of ceiling panel support runners and one or more connectors for connecting together these runners. Each of these connectors includes a pair of prongs for each support runner connected therewith. Each prong in turn includes a guide and reinforcing element which cooperates with an associated support runner to facilitate assembly of the support runners to the connector and to compensate for a weight imbalance during assembly of the overall ceiling arrangement.

4 Claims, 6 Drawing Figures

18
10
18a
18b
16b
26a
20a
16
32a
24a
38
30a
34a
22a
42
44
28a
36a
12a
24b
20b
12
32b
26b
30b
40
16a
28b
36b
34b
12b
22b
14
14a 62b
64b
58b
46
56a
60b
62a
58b
64a
60a
58a
50
54
54
52
66a
66b
48

CEILING GRID ARRANGEMENT AND CONNECTOR USED THEREWITH

BACKGROUND OF THE INVENTION

The present invention relates generally to a modular ceiling construction of the type disclosed in, for example, U.S. Pat. No. 3,848,385 issued to Neil J. Thompson on Nov. 19, 1974 and more particularly to an improvement in a ceiling construction of this type.

In the patent just recited, the modular ceiling constructin disclosed includes a number of elongated members referred to generally as main runners for supporting ceiling tile and connector means for interconnecting the main runners into a rectangular grid pattern. Each of these connector means is comprised of a central portion and a plurality of integral stub channel portions. Each of the stub channel portions is a generally U-shaped cross-section similar to the cross-section of the main runners. These stub channel portions are of geometry complimentary to that of the main runners so as to permit a predetermined inner fitting between the stub portions and runners.

As will be seen hereinafter, the present invention is directed to an improved connector for connecting together a number of main runners of the general type disclosed in the Thompson patent. More specifically, as will also be seen hereinafter, the connector disclosed herein and used as a part of a grid arrangement in an overall ceiling grid system is one which facilitates assembly of the main runners and connector and one which minimizes misalignment of one or more assembled runners prior to the assembly of additinal runners.

SUMMARY OF THE INVENTION

An object of the present invention is to provide a ceiling grid arrangement which includes a plurality of support runners and a connector which readily connects adjacent ends of the support runners together.

Another object of the present invention is to provide a connector which is constructed so that an associated support runner may be rapidly and reliably connected therewith.

Still another object of the present invention is to provide a connector which while supporting some of the runners prior to the assembly of other runners to be connected therewith it supports the already assembled runners in a way which minimizes misalignment of these runners prior to and during assembly of the other runners to be connected therewith.

The ceiling grid arrangment disclosed herein includes a plurality of support runners which may be similar in many ways to the main support runners disclosed in the Thompson patent. A typical support runner disclosed herein includes a horizontally extending, longitudinal base which itself includes an intermediate raised section extending the length of the base. A pair of horizontally extending side members are connected with and extend up from the base on opposite sides of and spaced from the intermediate raised section. These side members include adjacent laterally aligned end sections each of which has an uppermost portion which bends in towards the laterally aligned end portion of the other side member and down towards the base whereby to define a recess. These bent portions, actually the recesses defined thereby, are spaced laterally outwardly of the raised sectin in the base of the runner. All of these features are disclosed in the Thompson patent and comprise part of the main runner disclosed therein.

However, in a preferred embodiment, each of the runners disclosed herein includes a pair of laterally aligned stop members respectively connected with the aligned end sections of the horizontally extending side members. These stop members are located horizontally inward from the free ends of the end sections below the bent portions, i.e., below the recesses defined by the bent portions, and extend laterally inward toward one another.

The overall grid system also includes a connector which is constructed in accordance with the present invention and which is provided for connecting together a number of these runners. This connector includes a pair of laterally spaced and longitudinally extending flat prongs for each support runner to be connnected therewith. Each of these prongs has a free end section which is located within an associated runner between its intermediate raised section and one of its side members. The prong is spaced laterally from the raised section and extends up from the base of the runner into an associated recess in the adjacent side member. In addition, it extends longitudinally to an associated stop member which prevent further movement of the prong into the runner.

In accordance with the present invention, the connector includes a guide and reinforcing element which is connected with an end section of each prong below the end section's top portion, i.e., the portion located within an associated recess. Each of these elements extends towards and is laterally aligned with an adjacent side of the raised section of an associated runner and has a free end adjacent to the adjacent side of the raised section, preferably in engagement therewith.

As will be seen hereinafter, these guide and reinforcing elements aid in assuring that the free ends of an associated pair of prongs engage against associated stop members comprising part of the support runner to be connected therewith, during assembly of the support runner with the connector. In addition, these guide and reinforcing elements reinforce the already assembled support runners against misalignment, particularly against a tendency for the assembled runners to twist prior to and during assembly of other runners, which tendency to twist may result from a weight imbalance in the overall grid system prior to completing assembly of the overall system.

DETAILED DESCRIPTION

Figure 1:
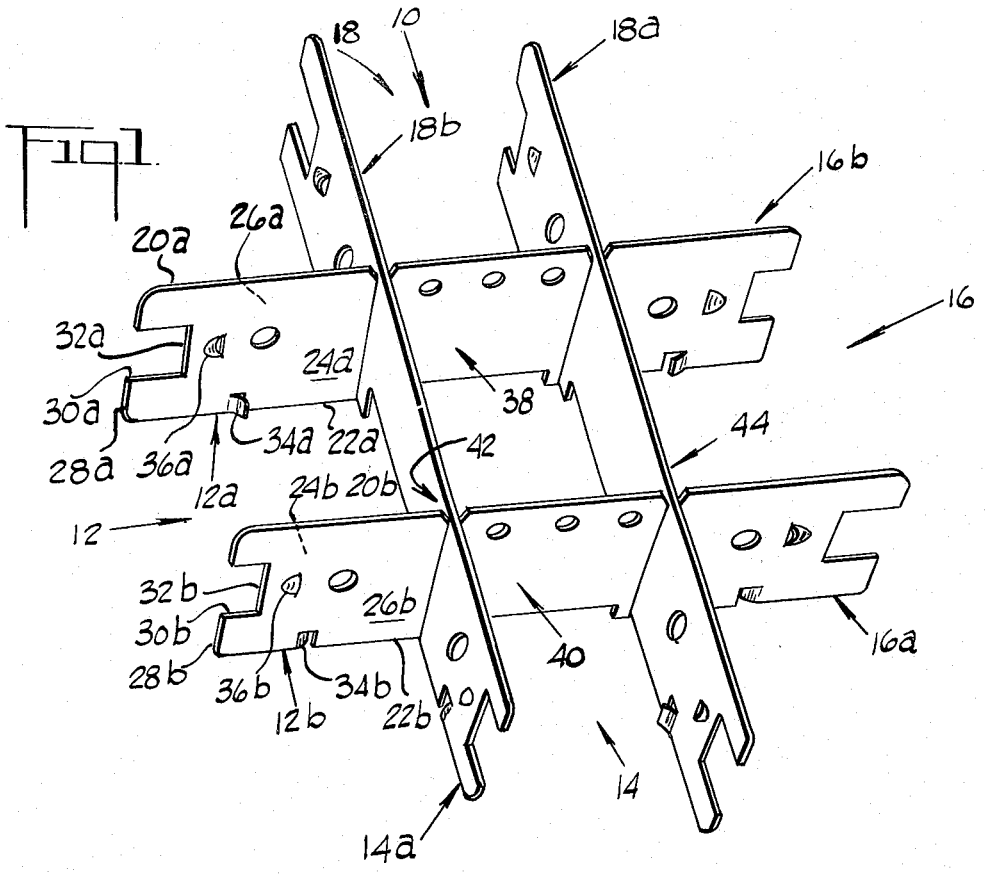
FIG. 1 is a perspective view of a connector constructed in accordance with the present invention and comprising part of a grid arrangement which itself comprises part of an overall ceiling grid system.

Turning to the drawings, wherein like components are designated by like reference numerals throughout the various figures, attention is first directed to a connector which is constructed in accordance with the present invention and which comprises part of a grid arrangement in an overall ceiling grid system to be discussed hereinafter. The connector, which is generally designated by the reference numeral 10 and which may be constructed of and suitable material for example metal, is illustrated in FIG. 1. As seen in this figure, connector 10 includes four pairs of prongs or connecting elements, generally designated at 12, 14, 16 and 18 respectively. The prongs of each pair are designated by the reference numeral of the pair with the suffix letters a and b distinguishing one prong from the other. For example, the pair of prongs designated by reference numeral 12 includes a prong 12*a* and a prong 12*b*. The pair designated by the reference numeral 14 includes prongs 14*a* and 14*b* and so on. All four pair of prongs are preferably identical and, hence, only one pair, for example, pair 12 will be described in detail.

As illustrated in FIG. 1, prong 12*a* is a flat, longitudinal member which when assembled, as will be seen hereinafter, extends horizontally. Prong 12*a* includes a top, longitudinally or horizontally extending edge 20*a* and a parallel, vertically aligned bottom edge 22*a*. The prong also includes an inner side surface 24*a* and an outer side surface 26*a*, both of which extend between top and bottom edges 20*a* and 22*a*, and an outermost end designated generally at 28*a*. Outermost end 28*a* includes an inwardly directed notch 30*a* so as to define an inwardly located end edge 32*a* which extends normal to the top and bottom edges of the prong.

The shape of prong 12*b*, with one exception to be discussed directly below, is preferably identical to that of prong 12*a*. Accordingly, prong 12*b* includes top and bottom edges 20*b* and 22*b* respectively, inner and outer side surfaces 24*b* and 26*b* respectively and an outermost end 28*b* defining a slot 20*b* therein, which slot in turn defines an end edge 32*b*.

Prongs 12*a* and 12*b* are parallel to and laterally aligned with one another and are of the same length so that end edges 32*a* and 32*b* are laterally aligned with one another or, if they are not of the same length, the end edges 32*a* and 34*b* are nevertheless preferably laterally aligned with one another. With regard to this latter feature, where for example prong 12*a* is longer than prong 12*b*, which is preferable to facilitate assembly, as will be discussed, it is preferred that the slot 30*a* be deeper than the slot 30*b* a sufficient amount to align end edge 32*a* with edge 32*b*. These prongs are held in position, spaced a predetermined distance from one another by means to be described hereinafter.

In accordance with the present invention, prong 12*a* and prong 12*b* include what may be referred to for reasons to become apparent hereinafter as guide and reinforcing elements designated at 34*a* and 34*b*. As illustrated in FIG. 1, guide and reinforcing element 34*a* is located inwardly of prong end 28*a* and end edge 32*a* and extends towards prong 12*b* from inner side surface 24*a*. In a similar fashion, guide and reinforcing element 34*b* is located inwardly of prong end 28*b* and end edge 32*b* and extends towards prong 12*a* from inner side surface 24*b*. These elements are preferably laterally aligned with one another and both are positioned in much closer proximity to bottom edges 22*a* and 22*b* respectively than to top edges 20*a* and 20*b*. In fact, they are preferably located adjacent to respective bottom edges 22*a* and 22*b*.

In a preferred embodiment, element 34*a* is not normal to side surface 24*a* but rather extends out from this surface and back towards the back end of prong 12*b* at an angle with surface 24*a*. In a similar fashion, element 34*b* preferably extends out from surface 24 towards the back end of prong 12*a* at an angle with surface 24*b*. In an actual working embodiment, guide and reinforcing elements 34*a* and 34*b* comprise integral parts of prongs 12*a* and 12*b* and are actually formed by punching out portions of the prongs to form the guide elements, as illustrated in FIG. 1.

In addition to elements 34*a* and 34*b*, prongs 12*a* and 12*b* may include and preferably include elements 36*a* and 36*b* respectively which, as will be seen hereinafter, are provided for interlocking the prongs with a support runner to be connected therewith. Element 36*a* extends outward from side surface 26*a* longitudinally between end edge 32*a* and guide and reinforcing element 34*a*. Element 36*b* extends out from side surface 26*b* between end edge 32*b* and element 34*b*. In an actual working embodiment, these interlocking elements are integral parts of prongs 12*a* and 12*b* and are formed by punching out portions of the prongs.

As stated previously, prong pairs 14, 16 and 18 are preferably identical to prong pair 12 and hence the prongs making up each of these pairs are preferably identical to prongs 12*a* and 12*b* including guide and reinforcing elements 34*a* and 34*b* and interlocking elements 36*a* and 36*b*. As illustrated in FIG. 1, prong pair 16 is located directly behind and extends in the opposite direction as prong pair 12 and prong pairs 14 and 18 are located directly behind one another so as to extend in opposite directions and extend perpendicular to prong pairs 12 and 16. In this manner, the four pairs of prongs are capable of supporting four support runners in a perpendicular criscross or grid-like fashion.

Connector 10 may include any suitable means for connecting prongs 12*a*, 12*b*, 14*a*, 14*b*, and so on in the manner described above. However, in accordance with an actual working embodiment of the present invention, prong 12*a* and prong 16*b* comprise opposite end sections a continuous member generally designated at 38. In a similar manner, prongs 12*b* and 16*a* comprise opposite end sections of a continuous member 40, prongs 14*a* and 18*b* comprise opposite end sections of a continuous member 42 and prong 14*b* and 18*a* comprise opposite end sections of a continuous member 44. Each of these members 38, 40, 42 and 44 includes spaced apart slots separating the member into the two prong sections and a central section therebetween. The slots in members 38 and 40 extend up from their bottom edges towards but stopping short of their top edges and the slots in members 42 and 44 extend down from their top edges towards but stopping short of their bottom edges. In this manner, the slots in members 38 and 40 can be aligned with the slots in members 42 and 44 to interconnect the four members together to form the grid illustrated in FIG. 1. These members are held fixed in this position by either a tight fit or other suitable means.

Having described connector 10, attention is now directed to a typical support runner comprising part of a ceiling grid arrangement along with connector 10.

Figure 2:
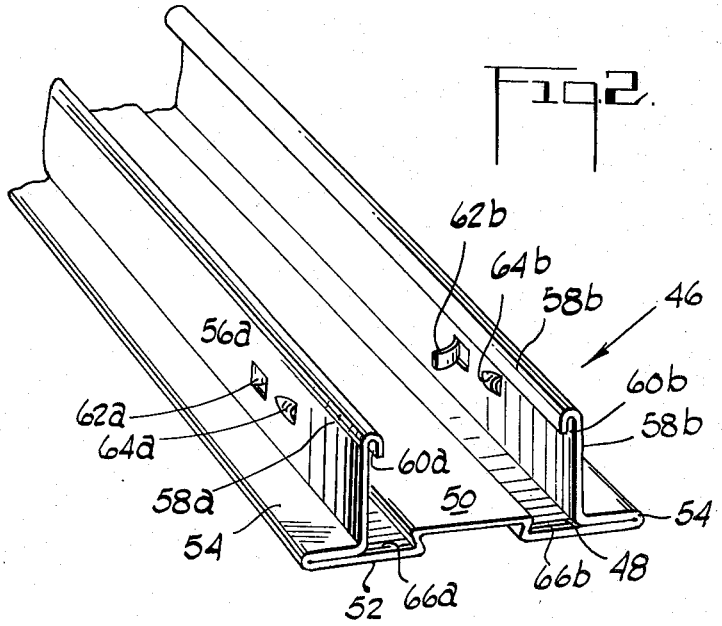
FIG. 2 is a perspective view of the end section of a support runner which is to be connected with the connector illustrated in FIG. 1 and which also comprises part of the grid arrangement.

This support runner, generally designated by the reference numberal 46 in FIG. 2, includes a horizontally extending longitudinal base generally designated at 48. Base 48 includes an intermediate raised section 50 which extends the length of the base from one end of the runner, generally designated as 52 to the other end of the runner (not shown). As seen in FIG. 2, base 48 turns up on itself at its opposite lateral edges so as to define flanges 54 for supporting ceiling tile, lighting fixtures or the like.

Support runner 46 also includes a pair of horizontally extending side members 56*a* and 56*b* connected with and extending vertically up from base 52 on opposite sides of and spaced from raised section 50. These side members or at least adjacent, laterally aligned end sections of these members include uppermost end portions, generally designated at 58*a* and 58*b*, which bend back toward the laterally aligned end portion of the other member and down towards base 48 to define downwardly facing recesses 60*a* and 60*b*. As seen in FIG. 2, these bent portions defining recesses 60*a* and 60*b* are spaced laterally outwardly of raised section 50.

As also seen in FIG. 2, runner 46 includes a pair of laterally aligned stop members respectively connected with the end sections of side members 56*a* and 56*b*. These stop members, generally designated at 62*a* and 62*b* are located horizontally inward from the free ends of side members 56*a* and 56*b* below recesses 60*a* and 60*b* and extend laterally toward one another from the inner surfaces of these side members. As will be seen hereinafter, these stop members, which are preferably integrally formed with side members 56*a* and 56*b*, actually punched out in a working embodiment, are provided for preventing associated prongs from entering completely into the runner from runner end 52.

Runner 46 may also include recesses, preferably punched out recesses in the inner walls of side members 56*a* and 56*b*. These recesses, which are aligned with one another, are located between the free ends of side members 56*a* and 56*b* and stop elements 62*a* and 62*b*, as illustrated. As will be seen below, these recesses, designated at 64*a* and 64*b*, cooperate with corresponding interlocking elements on a pair of prongs, for example elements 36*a* and 36*b* on prongs 12*a* and 12*b* to prevent the prongs from separating from the runner once assembled therewith.

From the foregoing, it should be apparent that a laterally extending longitudinal space exists between the bottom longitudinal edge of side member 56 and one side of raised section 50. A similar space also exists between the opposite side of the raised section 50 and the bottom longitudinal edge of side member 56*b*. These spaces are designated by the reference numerals 56*a* and 56*b* in FIG. 2.

Figure 3:
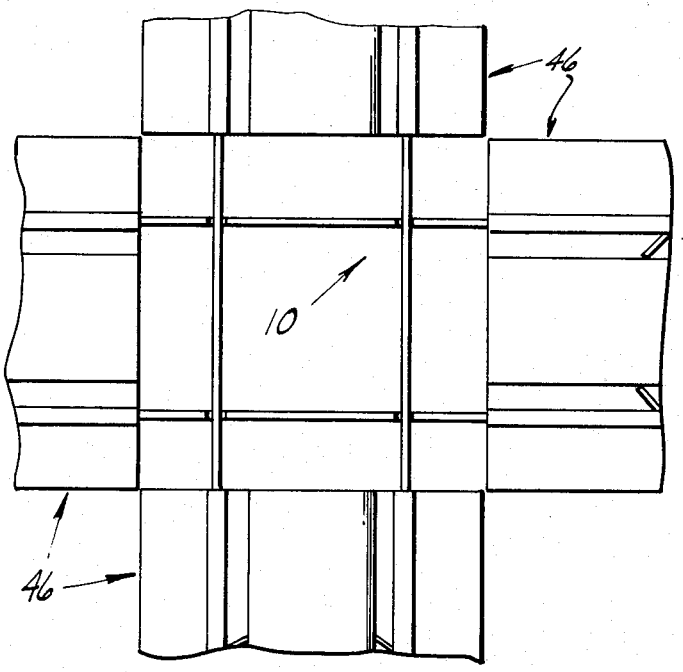
FIG. 3 is a top plan view of the connector illustrated in FIG. 1 and shown connected together with adjacent ends of four support runners of the type illustrated in FIG. 2.

As illustrated in FIG. 3, connector 10 is adapted to support the adjacent ends of four runners 46 in a crisscross grid type fashion. A cover cap (not shown) would be used to cover connector 10. The other ends of these runners would be supported either by other identical connectors 10, by connectors similar to connector 10 that include less than four pairs of prongs or by other suitable means. As stated previously, these connectors and support grids comprise part of a grid arrangement which in turn comprises part of an overall ceiling grid system. There are obviously other components in the overall grid system. For purposes of clarity, these other components have not been illustrated and will not be discussed in detail. It should suffice to say that the overall system includes for example means for supporting the connectors in position, for example a guide wire, it includes ceiling panel supported by the support grid and it includes what may be referred to as secondary support runners extending between various runners 46. Many of these components and other components not discussed in the overall ceiling grid system are illustrated in the previously cited Thompson U.S. Pat. No. 3,848,385.

Figure 4:
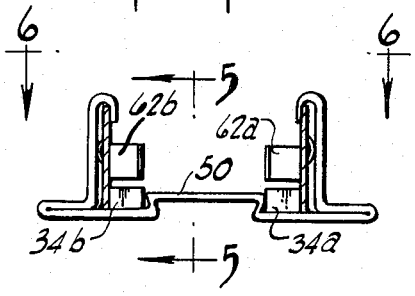
FIG. 4 is a cross-sectional view illustrating how one of the support runners is assembled with the connector, taken generally along line 4—4 in FIG. 3.
Figure 5:
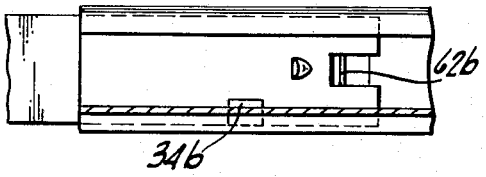
FIG. 5 is a longitudinal sectional view of one of the assembled support runners, taken generally along line 5—5 in FIG. 4.
Figure 6:
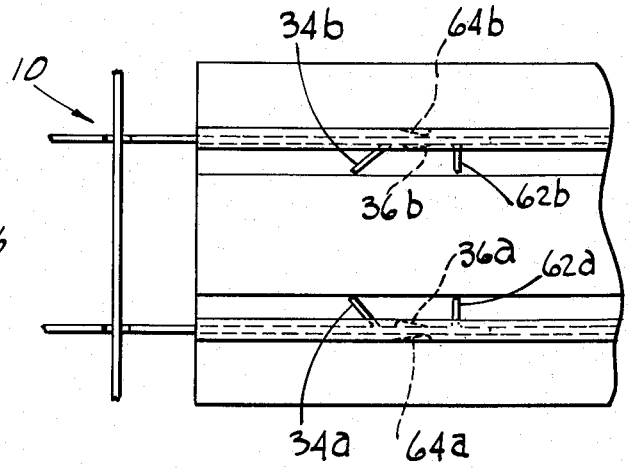
FIG. 6 is a plan view of an assembled runner, taken generally along line 6–6 in FIG. 4.

Turning to FIGS. 4, 5 and 6, attention is now directed to the manner in which a support runner 46 and a pair of prongs, for example prongs 12*a* and 12*b* of connector 10 are assembled together. As seen in these figures, the two prongs enter into the associated support runner from for example end 52. As stated previously, prong 12*a* is preferably longer than prong 12*b*. This facilitates insertion of the prongs into the runner. Prong 12*a* once within the runner is located between intermediate raised section 50 of the runner and side member 56*a* and is spaced laterally from the raised section. The prong extends to stop member 62*a* such that end edge 32*a* engages against the stop member as illustrated in FIG. 5. As seen best in FIG. 4, the longitudinally extending top portion of prong 12*a* is located within recess 60*a* defined by bent portion 58*a*. With the prong in this position, interlocking element 36*a* of the prong fits within recess 64*a* inside member 56*a* so as to prevent the prong from moving back out of the runner. Prong 12*b* is located within recess 60*b* and against stop member 62*b* in the inner side of side member 58*b* in the same manner.

In accordance with the present invention and as best illustrated in FIGS. 4 and 6, with prongs 12*a* and 12*b* in their ultimate position within runner 46, guide and reinforcing elements 34*c* and 34*b* extend across the recesses 66*a* and 66*b*, i.e., the lateral areas between the bottom of the side members 56*a* and 56*b* and the sides of raised portion 50 so that the free ends of elements 34*a* and 34*b* are in close proximity to, preferably an engagement with, the sides of raised portion 50. These elements reinforce the connection between prongs 12*a* and 12*b* and the end section of runner 46 against the tendency of the runners to twist. This is of particular value during assembly of the overall support grid system. More specifically, during assembly of the overall system a number of runners may be connected to a given connector before all of the runners are connected therewith. The connector and connected runners are subject to an imbalance in the overall system which in turn creates the tendency for misalignment between the runners and connectors, for example a twisting of the runners. These guide and reinforcing elements provide resistance to prevent this misalignment from occuring in a rather uncomplicated and reliable fashion.

In addition to the elements 62*a* and 62*b* functioning as a reinforcement, they also function in a way which assures that the end edges 32*a* and 32*b* engage stop members 62*a* and 62*b* as the prongs are inserted into the runner. More specifically, without elements 34*a* and 34*b*, prongs 12*a* and 12*b* have a tendency to bend in as they are inserted into the runner. It has been found that this creates the possibility that the end edges miss the stop members which not only creates a misalignment between interlocking elements 36*a* and 36*b* and recesses 64*a* and 64*b* but also throws off the overall tolerance dimensions of the grid system with regard to the connection of a number of connectors with a number of runners.

What we claim is:

1. A ceiling grid system comprising:

a. a plurality of support runners, each of which includes i. a horizontally extending, longitudinal base including an intermediate raised section extending the length of the base, ii. a pair of horizontally extending side members connected with and extending up from said base on opposite sides of and spaced from said raised section, said side members including adjacent laterally aligned end sections, each of which has an uppermost portion which bends in towards the laterally aligned end portion of the other side member and down towards said base to define a recess, said bent portions being spaced laterally outwardly of said raised section, and iii. a pair of laterally aligned stop members respectively connected with said end sections horizontally inward of the free ends of said end sections below said bent portions, said stop members extending laterally inward toward one another; and b. a connector for connecting together said runners, said connector including i. a pair of laterally spaced longitudinally extending flat prongs for each support runner to be connected therewith, each of said prongs having a free end section located within an associated runner between its intermediate raised section and one of its side members, spaced laterally from said raised section and extending up from the base of the associated runner, said end section extending to an associated stop member and having a longitudinally extending top portion located within the recess defined by the bent portion of said one side member, and ii. a guide and reinforcing element connected with an end section of each of said prongs below the end section's top portion which is located within an associated recess, each of said elements extending towards and laterally aligned with an adjacent side of the raised section of an associated runner and having a free end adjacent said adjacent side of said raised section.

2. A system according to claim 1 wherein the free ends of each of said guide and reinforcing elements engages with an associated adjacent side of the raised section of an associated runner.

3. A system according to claim 1 wherein each of said elements is integrally formed with an associated prong.

4. A central connector for connecting together a plurality of ceiling support runners in a ceiling grid system, said connector comprising:

a. a pair of prongs for each of said support runners to be connected together, each of said prongs having i. a free end ii. horizontally extending top and bottom edges, and iii. inner and outer side surfaces extending vertically between said edges;

b. said prongs comprising a given pair being aligned with and laterally spaced from one another so that an inner side surface of each confronts an inner side surface of the other; and c. a guide and reinforcing element connected with each of said prongs, each of said elements extending out a predetermined distance from an inner side of the prong to which it is connected at the bottom edge of the prong.

* * * * *